US010220283B2

(12) United States Patent
Rosberger et al.

(10) Patent No.: US 10,220,283 B2
(45) Date of Patent: Mar. 5, 2019

(54) FENCING SWORD WITH ADJUSTABLE WEIGHTS

(71) Applicants: Haylen Tshering Rosberger, New York, NY (US); Jessica Tshering Rosberger, New York, NY (US)

(72) Inventors: Haylen Tshering Rosberger, New York, NY (US); Jessica Tshering Rosberger, New York, NY (US)

( * ) Notice: Subject to any disclaimer, the term of this patent is extended or adjusted under 35 U.S.C. 154(b) by 0 days.

(21) Appl. No.: 15/450,957

(22) Filed: Mar. 6, 2017

(65) Prior Publication Data

US 2017/0252627 A1 Sep. 7, 2017

Related U.S. Application Data

(60) Provisional application No. 62/304,492, filed on Mar. 7, 2016.

(51) Int. Cl.

| | |
|---|---|
| ***A63B 69/02*** | (2006.01) |
| *A63B 15/00* | (2006.01) |
| *A63B 21/072* | (2006.01) |
| *A63B 23/14* | (2006.01) |

(52) U.S. Cl.

CPC ..... *A63B 69/02* (2013.01); *A63B 15/00* (2013.01); *A63B 21/072* (2013.01); *A63B 23/14* (2013.01); *A63B 2210/00* (2013.01)

(58) Field of Classification Search

CPC ..... A63B 69/02
USPC ..... 463/47.1
See application file for complete search history.

(56) References Cited

U.S. PATENT DOCUMENTS

| | | | | |
|---|---|---|---|---|
| 1,026,990 | A * | 5/1912 | Matson | A63B 60/02 473/49 |
| 2,198,980 | A * | 4/1940 | Sullivan | A63B 53/14 33/508 |
| 5,460,378 | A * | 10/1995 | Getts | A63B 69/3638 473/238 |
| 6,083,116 | A * | 7/2000 | Loredo | A63B 69/3638 473/256 |
| 6,612,936 | B1 * | 9/2003 | Matias | A63B 69/3638 473/256 |
| 8,444,500 | B2 * | 5/2013 | Erkkinen | A63B 69/3638 473/226 |
| 9,463,363 | B2 * | 10/2016 | Dingman | A63B 53/14 |
| 2009/0007434 | A1 * | 1/2009 | Kwok | B26B 3/00 30/125 |

OTHER PUBLICATIONS (Re)Wire an Electric Fencing Foil, posted Jul. 9, 2007 http://www.instructables.com/id/ReWire-an-Electric-Fencing-Foil/.*

* cited by examiner

*Primary Examiner* — Omkar A Deodhar
*Assistant Examiner* — Ross A Williams
(74) *Attorney, Agent, or Firm* — Katten Muchin Rosenman LLP

(57) ABSTRACT

The fencing sword comprises a handle, a guard, and a short shaft in place of the blade. Weights may be added/removed from the shaft to adjust the weight of the fencing sword. The weights can additionally be added/removed from other fencing swords having different handle designs from other forms of fencing. In some embodiments, a laser pointer is mounted to or near the shaft. The laser may register on a target mimicking scoring a touch in a bout and can be used to train a user's accuracy.

9 Claims, 8 Drawing Sheets

FENCING SWORD WITH ADJUSTABLE WEIGHTS

FIELD OF THE INVENTION

The present invention is related to a fencing sword used for fencing practice. More particularly, the present invention is directed to a fencing sword having a shortened blade with adjustable weights.

BACKGROUND

Fencing is a sport in which two competitors fight using swords, winning points by making contact with an opponent. There are three forms of modern fencing, foil, epée, and sabre, each of which has its own sword style and set of rules. Fencers typically practice using a full sized fencing sword which requires a great deal of room to maneuver. Further, fencing swords typically come in different weights and there is no easy way to adjust the weight during training without having multiple swords to choose from. Accordingly, it is an aim of the present invention to provide a fencing sword that can be used for practice while also being adjustable.

SUMMARY

The fencing sword comprises a handle, a guard, and a short shaft in place of the blade. Weights may be added/removed from the shaft to adjust the weight of the fencing sword. The weights can additionally be added/removed from other fencing swords having different handle designs from other forms of fencing. In some embodiments, a laser pointer is mounted to or near the shaft. The laser may register on a target mimicking scoring a touch in a bout and can be used to train a user's accuracy.

DETAILED DESCRIPTION

Figure 1:
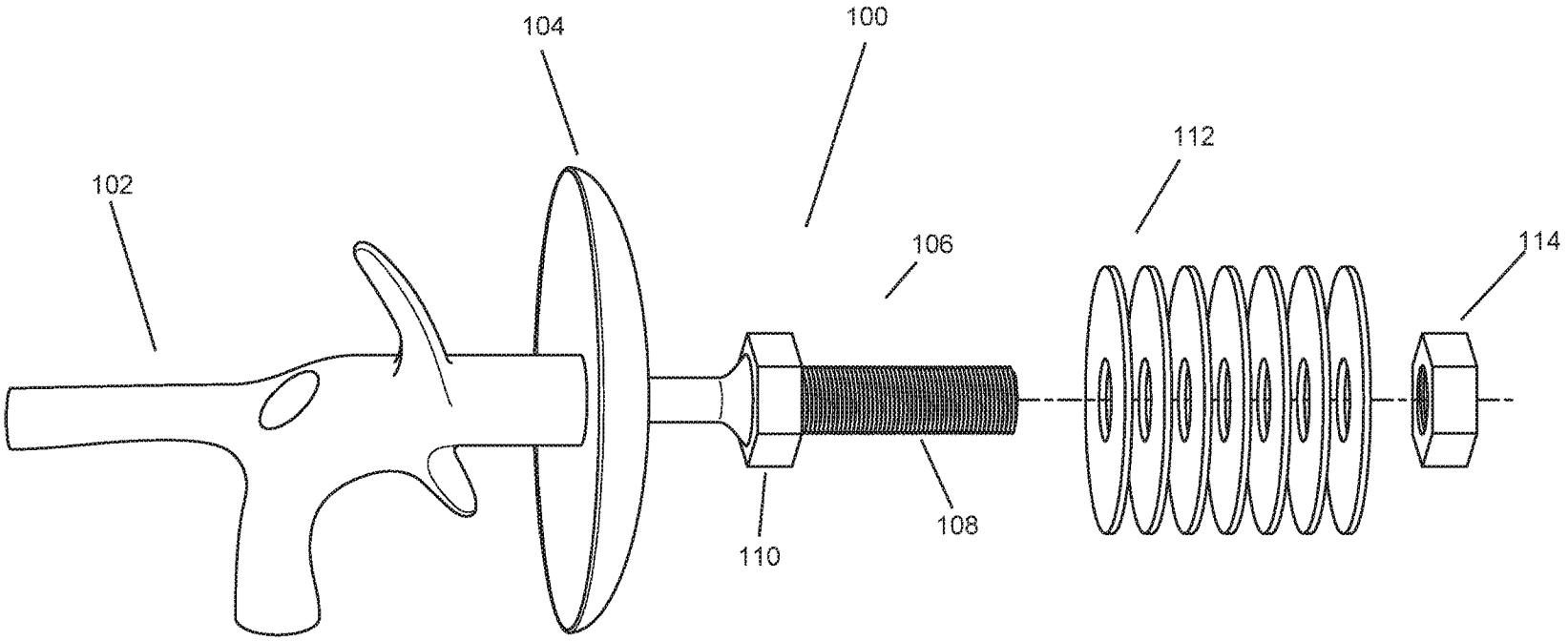
FIGS. 1-3 depict views of the fencing sword having a foil grip.

Referring first to FIG. 1, the fencing sword 100 generally comprises grip 102, guard 104, and blade 106. The fencing sword 100 is shown here in an exploded view for clarity. Grip 102 can be any standard grip for a fencing sword. Grip 102 depicted in FIG. 1 is a standard foil grip. Other embodiments will be described later. Similarly, guard 104 may be any standard guard design commonly used in fencing swords such as foils, epées, and sabres. Guard 104 depicts in FIG. 1 is a bell guard.

Blade 106 comprises shaft 108, bolt 110, weights 112, and fastener 114. A distal end of blade 106 is threaded to allow fastener 114 to secure weights 116 between bolt 110 and fastener 114. In this embodiment, the weights 112 are circular rings with a central bore approximately the same diameter as the thickness of shaft 108. The number of weights 112 can be varied by simply adding or removing them from shaft 108. In other embodiments, the shaft 108 and central bore of the weights 112 may have another shape, such as a square or rectangular, to prevent rotation or movement of weights 112 during training.

Weights 112 serve to stabilize fencing sword 100 and allow it to mimic the weight of a normal fencing sword. As previously discussed, different fencing swords can be mimicked by adding or removing weights 112 to reflect the weight of the desired fencing swords. Further, additional weights 112 can be added to increase the effort needed to wield fencing sword 100, thereby increasing the strength of the fencer. The fencing sword 100 can also be particularly useful for children learning fencing because weights 112 can gradually be added as a child advances or ages. The fencing sword 100 also provides a lower cost practice option because various grips 102 and weights 112 can be sold separately or together in a single package.

Weights 112 may be placed anywhere from guard 104 to the tip of shaft 108. The further away that weights 112 are placed from guard 104, the more effect the weights have on fencing sword 100 and a fencer's ability to control it. In a preferred embodiment, the overall length of fencing sword 100 is shorter than 15 inches, but preferably less than 12 inches. This allows fencing sword 100 to be used in more constrained environments than a typical fencing sword. Also, since fencing sword 100 is much shorter than a typical fencing sword, it is much easier to transport during travel and is not subject to security restrictions, such as the ban of weapons aboard airplanes.

Figure 2:
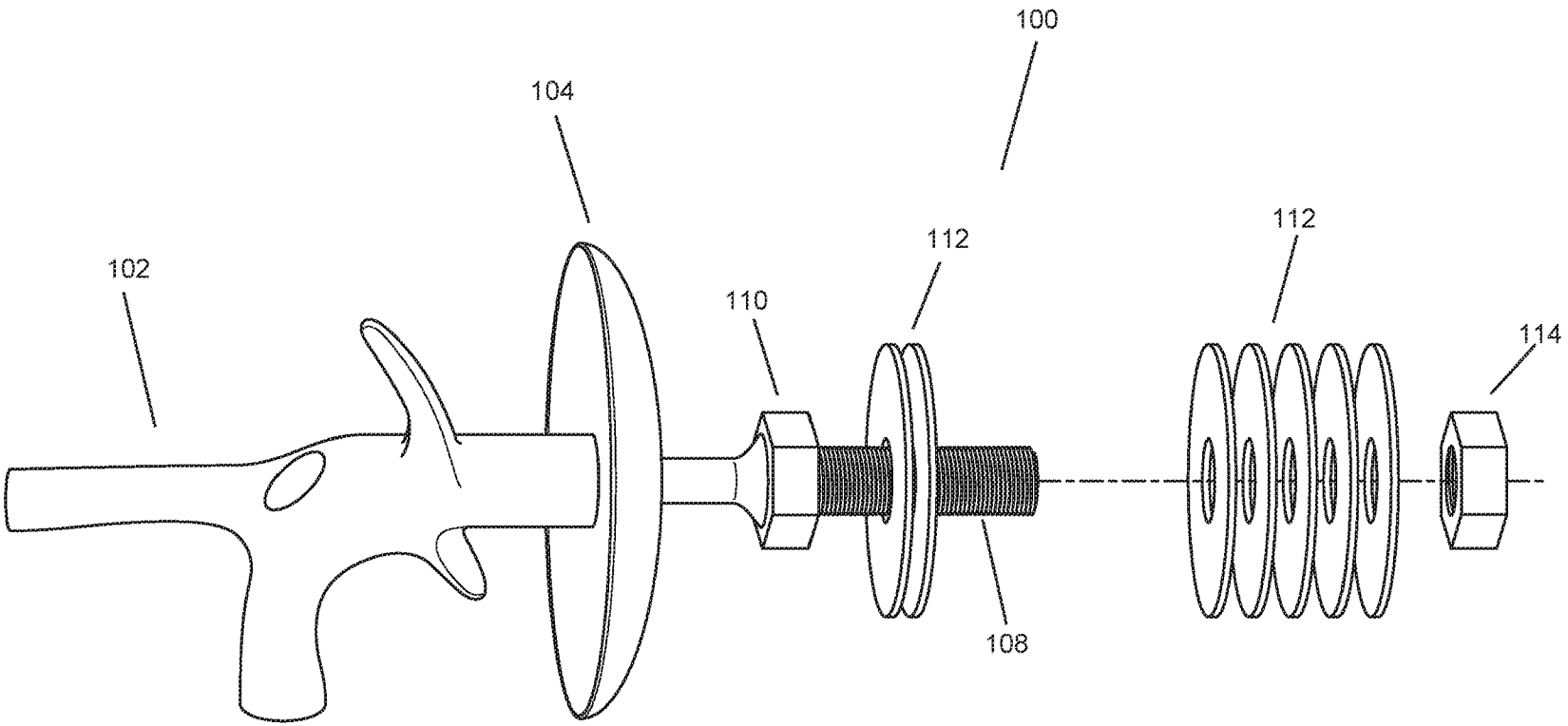
Figure 3:
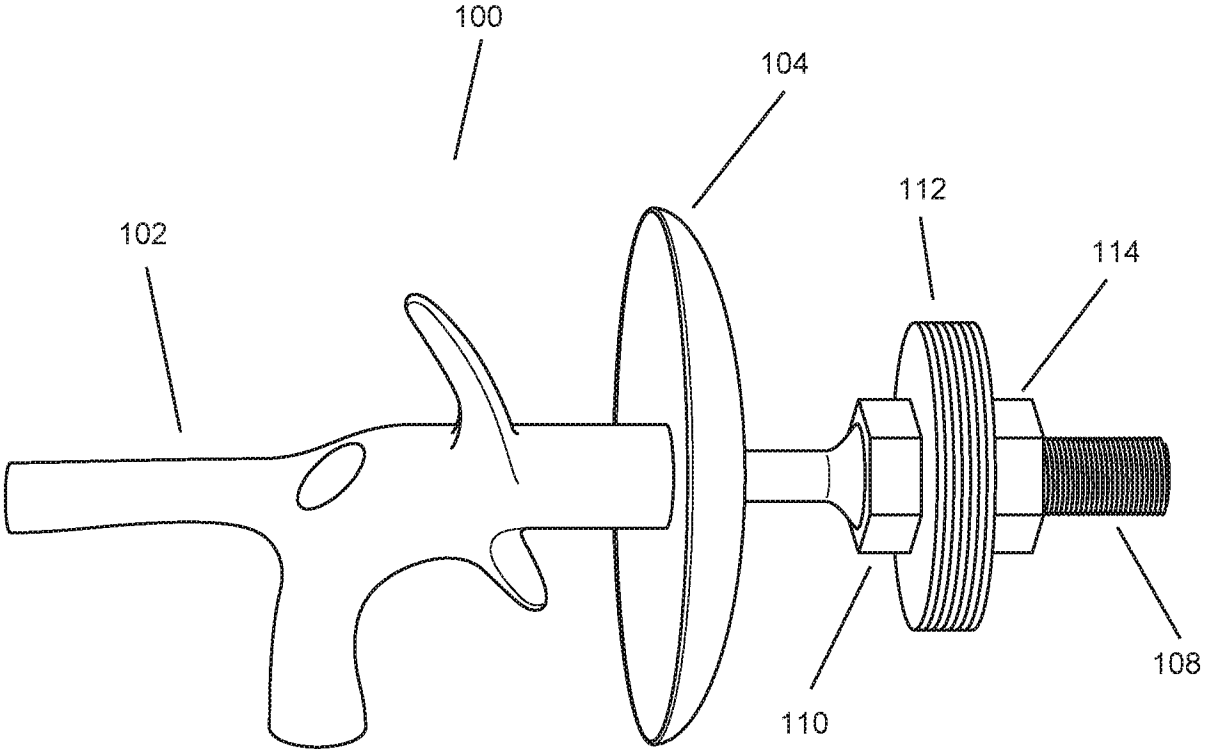

FIGS. 2 and 3 depict how weights 112 can be added or removed from shaft 108. First, as depicted in FIG. 2, the desired number of weights 112 are added to the threaded portion of shaft 108. The fastener 114 is then threaded onto shaft 108 to secure the weights 112 as depicted in FIG. 3. Fencing sword 100 provides a much more compact sword which can be used for practice. And, as previously described, the fencing sword 100 is more suitable for travel than a typical fencing sword which can be awkward to transport.

Figure 4:
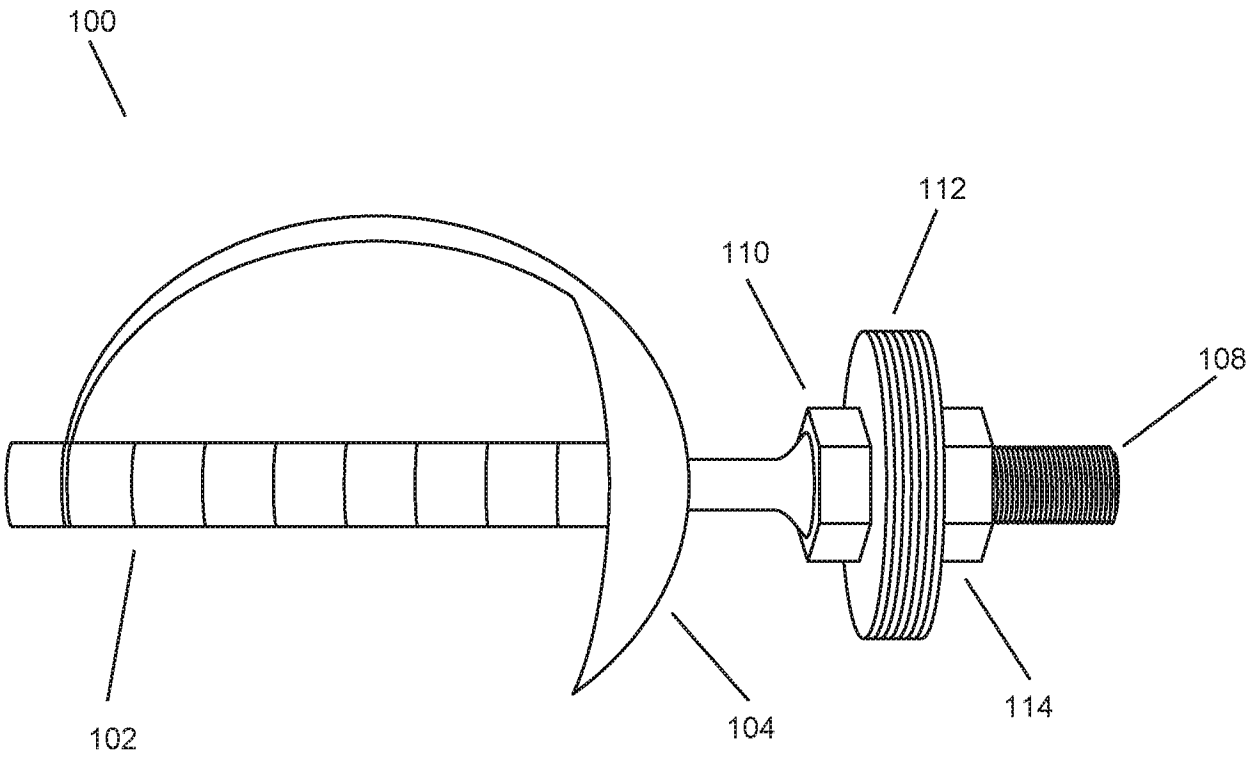
FIG. 4 depicts a fencing sword having a saber grip.
Figure 5:
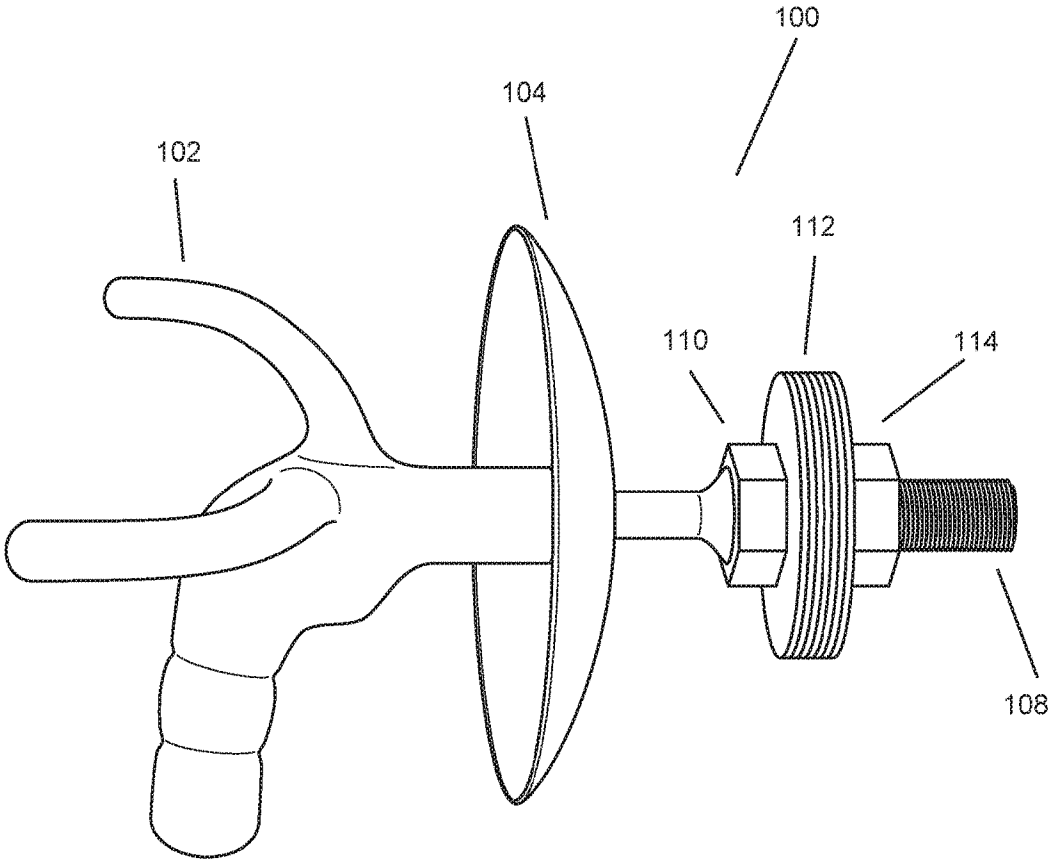
FIG. 5 depicts a fencing sword having a foil grip.
Figure 6:
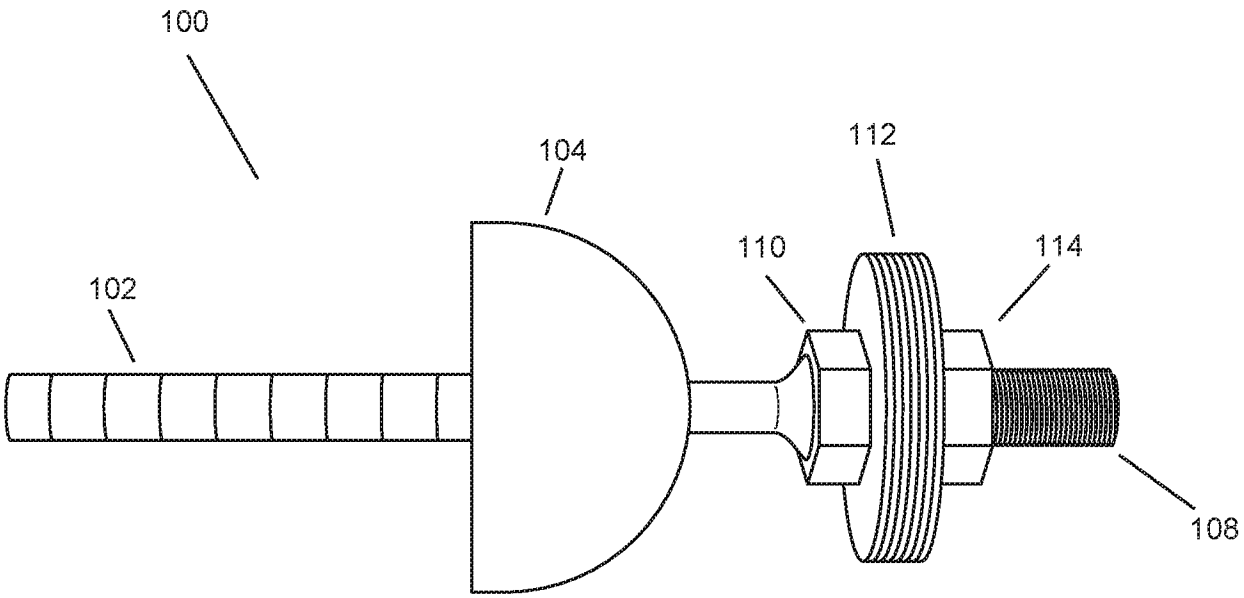
FIG. 6 depicts a fencing sword having an epée grip.

FIG. 4 depicts an alternate embodiment of fencing sword 100 having a different grip 102. In this embodiment, grip 102 is a standard saber grip and guard 104 is part of grip 102. This embodiment demonstrates how the same set of weights 112 can be used with multiple embodiments having different grips 102 and guards 104. As another example, FIG. 5 depicts a fencing sword 100 having a slightly different foil grip 102 and FIG. 6 depicts a epée grip 102. The fencing sword 100 also has a larger bell guard 104 as is common on epee fencing swords.

Figure 7:
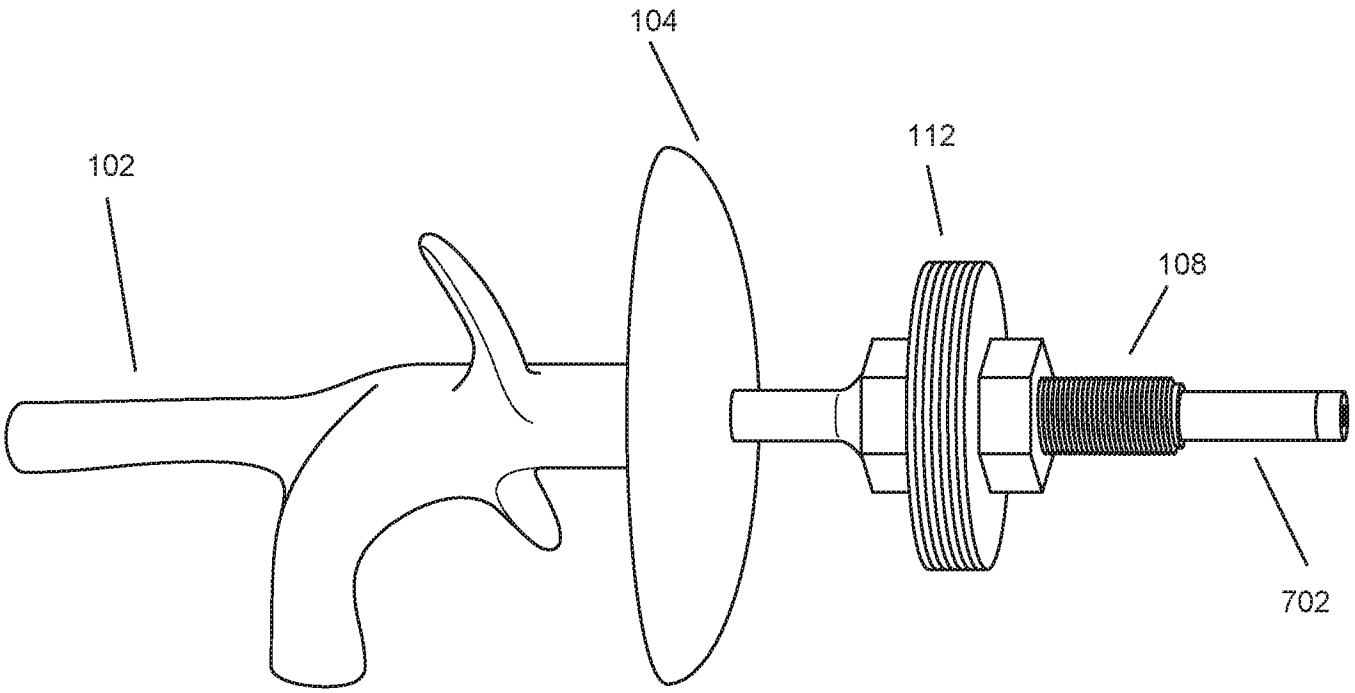
FIG. 7 depicts a fencing sword having a laser pointer attachment.

FIG. 7 depicts an alternate embodiment of fencing sword 100 in which a laser pointer 702 is located at a distal end of shaft 108. The laser pointer 702 is preferably aligned with a common axis of shaft 108 and can be used to register on a target mimicking scoring a touch in a bout. This can help during training to enhance a user's accuracy. The laser pointer 702 can be attached to the end of shaft 108 using different connection techniques such as via a threaded connection (screwing into an interior of the shaft 108 or over a threaded exterior).

Figure 8:
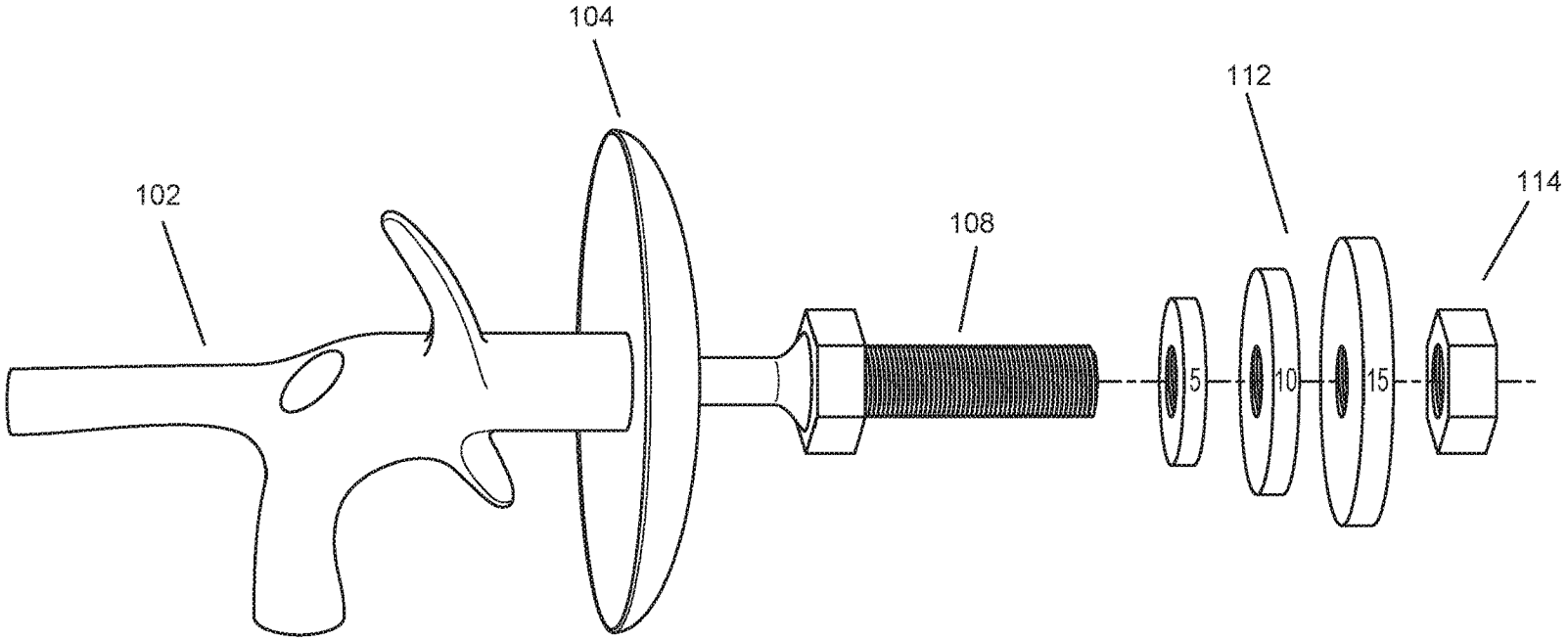
FIG. 8 depicts a fencing sword having marked adjustable weights.

FIG. 8 depicts an alternate embodiment of fencing sword 100 in which weights 112 are differently sized and weighted. As depicted, weights 112 may also be marked with identifiers 802 to indicate the weight (e.g., in grams, ounces, etc. of weight 112. Preferably, weights 112 are formed from a heavy/dense material such as a metal. Weights 112 and shaft 108 may also be of any shape (square, rectangular, hexagonal, etc.) as long as the shape is complimentary to allow weights 112 to be added or removed. Weights 112 may also be color coded or marked so that the fencer can easily ascertain the total weight of weights 112 on shaft 108.

Additionally, securing mechanism 114 is preferably a durable metal or plastic piece because it must secure weights 112 during quick movement by the fencer wielding fencing sword 100. In another embodiment, weights 112 can be secured to shaft 108 using other methods including clipping or screwing directly onto shaft 108. For example, as depicted in FIG. 8, the weights 112 have internal threads so they can be screwed onto shaft 108. In some embodiments, the entirety of blade 106 may be replaced and the different blades 106 take the places of weights 112. In such an embodiment, blade 106 would be attached directly to guard 104 (e.g., via a screw fit). Thus, fencing sword 100 can also be used as an actual fencing sword during competition as well as for training. Further, weights 112 can be secured to shaft 108 or guard 104 using magnets, hook and loop fasteners, a twist lock fit, or any other fasteners.

The invention claimed is:

1. An adjustable fencing sword comprising:

a grip configured to be held by a user;

a shaft extending away from the grip, wherein an end portion of the shaft comprises an external thread;

a plurality of weights for placement over the end portion of the shaft, each weight having a closed central bore having a diameter of approximately equal to a diameter of the shaft, wherein the plurality of weights are placed on the shaft by passing the shaft through the closed central bore of each of the plurality of weights; and a threaded fastener having an internal thread that mates with the threaded section for securing the plurality of weights to the shaft, wherein an entire length of the adjustable fencing sword extending from a tip of the grip to a tip of the shaft is approximately 12-15 inches.

2. The adjustable fencing sword of claim 1, further comprising:

a guard disposed between the grip and the shaft.

3. The adjustable fencing sword of claim 1, wherein the shaft and closed central bores are circular, And wherein the plurality of weights each has a shape of a washer.

4. The adjustable fencing sword of claim 1, wherein the shaft and central bores are rectangular or square.

5. The adjustable fencing sword of claim 1, further comprising:

a laser pointer mounted to a distal end of the shaft.

6. The adjustable fencing sword of claim 1, wherein a first weight of the plurality of weights has a different mass than a second weight of the plurality of weights.

7. The adjustable fencing sword of claim 1, wherein the plurality of weights are marked with a mass identifier.

8. The adjustable fencing sword of claim 1, wherein the grip is selected from a foil grip, an epée grip, or a saber grip.

9. The adjustable fencing sword of claim 1, further comprising:

a blade attachment having an interior thread for mating with the external thread of the shaft, wherein a length of the blade is a length of a standard fencing blade.

* * * * *